US009466408B2

(12) United States Patent
Sugiyama

(10) Patent No.: US 9,466,408 B2
(45) Date of Patent: Oct. 11, 2016

(54) MANUFACTURING DEVICE AND MANUFACTURING METHOD OF DIFFERENTIAL SIGNAL TRANSMISSION CABLE

(71) Applicant: Hitachi Metals, Ltd., Tokyo (JP)

(72) Inventor: Takahiro Sugiyama, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 145 days.

(21) Appl. No.: 14/555,888

(22) Filed: Nov. 28, 2014

(65) Prior Publication Data

US 2015/0170800 A1 Jun. 18, 2015

(30) Foreign Application Priority Data

Dec. 13, 2013 (JP) ..... 2013-257740

(51) Int. Cl.

| | |
|---|---|
| ***H01B 13/08*** | (2006.01) |
| ***H01B 13/26*** | (2006.01) |
| ***H01B 13/00*** | (2006.01) |
| *H01B 11/18* | (2006.01) |
| *H01B 11/20* | (2006.01) |

(52) U.S. Cl.

CPC ..... *H01B 13/0016* (2013.01); *H01B 13/0841* (2013.01); *H01B 11/183* (2013.01); *H01B 11/203* (2013.01); *Y10T 29/532* (2015.01)

(58) Field of Classification Search

CPC ..... H01B 13/08

See application file for complete search history.

(56) References Cited

U.S. PATENT DOCUMENTS

| | | | | |
|---|---|---|---|---|
| 6,010,788 | A * | 1/2000 | Kebabjian | H01B 11/002 174/102 R |
| 7,790,981 | B2 * | 9/2010 | Vaupotic | H01B 11/1008 174/113 R |
| 8,546,691 | B2 * | 10/2013 | Watanabe | H01B 11/18 174/102 R |
| 8,653,373 | B2 * | 2/2014 | Sugiyama | H01B 11/183 174/113 R |
| 2014/0034352 | A1 | 2/2014 | Sugiyama et al. | |

* cited by examiner

*Primary Examiner* — Jeff Aftergut

(74) *Attorney, Agent, or Firm* — Crowell & Moring LLP

(57) ABSTRACT

To provide a differential signal transmission cable in which there is no gap between an insulated wire and a shield tape, a manufacturing device thereof is a manufacturing device of a differential signal transmission cable including: a first retention tape spirally wound around an insulated wire in which a pair of signal line conductors is coated by an insulator; and a second retention tape spirally wound around the first retention tape. This manufacturing device includes a winding head that winds the first retention tape and the second retention tape around the insulated wire in the same direction, the insulated wire which moves along a longitudinal direction; and a twist preventing jig that is disposed ahead of the winding head in a movement direction of the insulated wire and prevents the insulated wire from being twisted.

11 Claims, 10 Drawing Sheets

MANUFACTURING DEVICE AND MANUFACTURING METHOD OF DIFFERENTIAL SIGNAL TRANSMISSION CABLE

CROSS-REFERENCE TO RELATED APPLICATION

The present application claims priority from Japanese Patent Application No. 2013-257740 filed on Dec. 13, 2013, the content of which is hereby incorporated by reference into this application.

TECHNICAL FIELD OF THE INVENTION

The present invention relates to a manufacturing device and a manufacturing method of a differential signal transmission cable in which two signals or more with different phases from one another are transmitted.

BACKGROUND OF THE INVENTION

In devices such a server, a router, a storage, and etc. that process high rate signals at several G bit/s or more, a differential interface standard (for example, LVDS (Low Voltage Differential Signaling)) is adopted, and differential signals are transmitted between the devices or between respective circuit substrates in the devices, using a differential signal transmission cable. The differential signals have an advantage of having a high resistance to incoming noise, while achieving reduction in system power supply voltage.

A conventional differential signal transmission cable includes an insulated wire in which a pair of signal line conductors arranged in parallel is coated by an insulator, a shield tape wound around the insulated wire, and a retention tape wound around the shield tape. The retention tape is spirally wound around the shield tape.

According to U.S. Pat. No. 7,790,981 (Patent Document 1), a plus (positive) signal and a minus (negative) signal having phases inverted by 180 degrees to each other are transmitted to the pair of signal line conductors included in the differential signal transmission cable. Based on a potential difference of these two signals at a signal level (plus signals and minus signals), the signal level can be recognized at a receiving side, for example, when the potential difference is plus as "High" and when the potential difference is minus as "Low".

SUMMARY OF THE INVENTION

In the differential signal transmission cable having the structure described above, when a gap is generated between the insulated wire and the shield tape, skew is increased, or signals are rapidly attenuated at a high-frequency band.

The present inventor has found that, in some cases, a gap is generated between the insulated wire and the shield tape when the retention tape is wound around the shield tape. Specifically, the insulated wire is twisted when the retention tape is wound around the shield tape, thereby generating the gap between the insulated wire and the shield tape because of the twist in some cases.

The present invention has been made in view of the finding described above, and it is an object of the present invention to prevent a gap between an insulated wire and a shield tape from being generated.

A manufacturing device of the present invention is a manufacturing device of a differential signal transmission cable including an insulated wire in which a pair of signal line conductors is coated by an insulator, a first tape spirally wound around the insulated wire, and a second tape spirally wound around the first tape. The manufacturing device of the present invention includes: a winding head that winds the first tape and the second tape around the insulated wire in a same direction, the insulated wire which moves along a longitudinal direction; and a twist preventing jig that is disposed ahead of the winding head in a movement direction of the insulated wire, and prevents the insulated wire from being twisted.

In one aspect of the manufacturing device of the present invention, a heating furnace that is disposed ahead of the winding head in a movement direction of the insulated wire, and thermally cures a bonding layer provided in at least either of the first tape and the second tape is provided. The twist preventing jig is disposed on a movement path of the insulated wire and between the winding head and the heating furnace.

In another aspect of the manufacturing device of the present invention, the twist preventing jig includes a restriction portion through which the insulated wire is passed, the insulated wire having the first tape and the second tape wound therearound. The restriction portion is a through-hole or a circular arc-shaped groove, which allows the insulated wire having the first tape and the second tape wound therearound to move along a longitudinal direction of the insulated wire, but restricts the insulated wire to rotate in a circumferential direction.

A manufacturing method of a differential signal transmission cable of the present invention includes: a first step of spirally winding a first tape around an insulated wire while moving the insulated wire in which a pair of signal line conductors is coated by an insulator in a longitudinal direction; and a second step of spirally winding a second tape around the first tape in a same direction as a winding direction of the first tape, while moving the insulated wire in a longitudinal direction. The first step and the second step are carried out in a state that the insulated wire is prevented from being twisted ahead of a winding position of the first tape and second tape for the insulated wire in a movement direction of the insulated wire.

In one embodiment of the manufacturing method of the present invention, the insulated wire is prevented from being twisted by passing a twist preventing jig through the insulated wire, the twist preventing jig disposed ahead of the winding direction in a movement direction of the insulated wire.

In another aspect of the manufacturing method of the present invention, a third step of thermally curing a bonding layer provided in at least either of the first tape and the second tape is included. The twist preventing jig is disposed between a winding head that carries out the first step and the second step and a heating furnace that carries for carrying out the third step.

In another aspect of the manufacturing method of the present invention, the twist preventing jig includes a restriction portion through which the insulated wire is passed, the insulated wire having the first tape and the second tape wound therearound. The restriction portion is a through-hole or a circular arc-shaped groove, and allows the insulated wire having the first tape and the second tape wound therearound to move along a longitudinal direction of the insulated wire, but restricts the insulated wire to rotate in a circumferential direction.

In another aspect of the manufacturing method of the present invention, the first tape and the second tape are retention tapes that ere overlapped with and wound on a shield tape, which is preliminarily wound around the insulated wire.

In another aspect of the manufacturing method of the present invention, the first tape is a shield tape to be wound around the insulated wire, and the second tape is a retention tape that is overlapped with and wound on the shield tape.

According to the present invention, a differential signal transmission cable in which there is no gap between an insulated wire and a shield tape is achieved.

BRIEF DESCRIPTIONS OF THE DRAWINGS

DESCRIPTIONS OF THE PREFERRED EMBODIMENTS

First Embodiment

Hereinafter, as to a manufacturing device and a manufacturing method of a differential signal transmission cable of the present invention, an example of an embodiment will be described. First, a structure of the differential signal transmission cable manufactured by a manufacturing device and a manufacturing method according to the present embodiment will be described.

Figure 1:
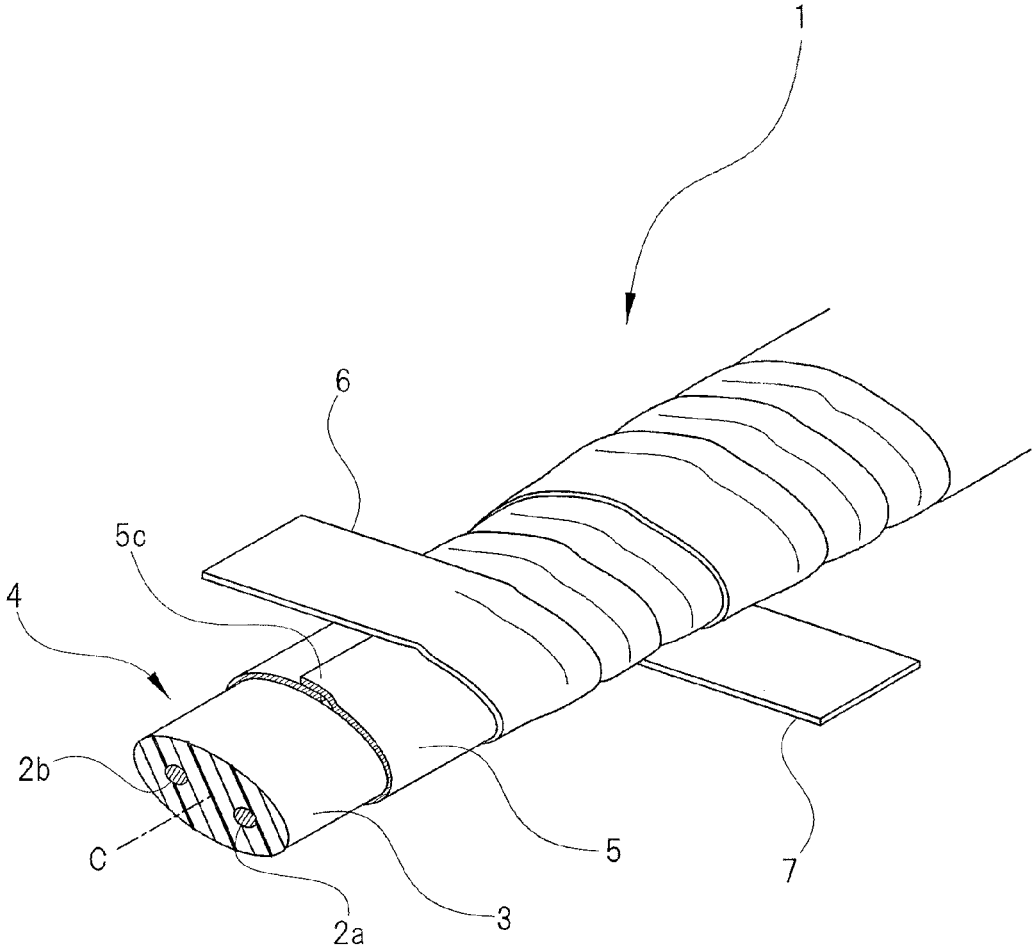
FIG. 1 is a perspective view illustrating an example of a differential signal transmission cable manufactured by a manufacturing device and a manufacturing method according to the present invention.

As illustrated in FIG. 1, a differential signal transmission cable 1 includes an insulated wire 4 in which a pair of signal line conductors 2*a* and 2*b* is collectively coated by an insulator 3. The differential signal transmission cable 1 further includes a shield tape 5 that is wound on the insulated wire 4, a first tape 6 that is wound on the shield tape 5, a second tape 7 that is wound on the first tape 6. That is, the shield tape 5, the first tape 6 and the second tape 7 are wound around the insulated wire 4 in this order.

The paired signal line conductors 2*a* and 2*b* are circular cross-section silver plated copper wires having a surface on which silver plating is applied. Plus (positive) signals are transmitted to one of the signal line conductors 2*a* and 2*b*, and minus (negative) signals are transmitted to the other of the signal line conductors 2*a* and 2*b*.

The insulator 3 is formed of foam-type insulating resin (expanded polyethylene in the present embodiment), and a large number of air bubbles (not illustrated) are included in the insulator 3. The insulator 3 retains the signal line conductors 2*a* and 2*b* such that the signal line conductors 2*a* and 2*b* are arranged in parallel at a predetermined distance. Further, the insulator 3 is formed such that a thickness in the periphery of the respective signal line conductors 2*a* and 2*b* is substantially equal. Note that a skin layer may be provided around the insulator 3. For example, a thin film that is composed of a sintered body of an ethylene-tetrafluoroethylene copolymer may be provided around the insulator 3.

Figure 2:
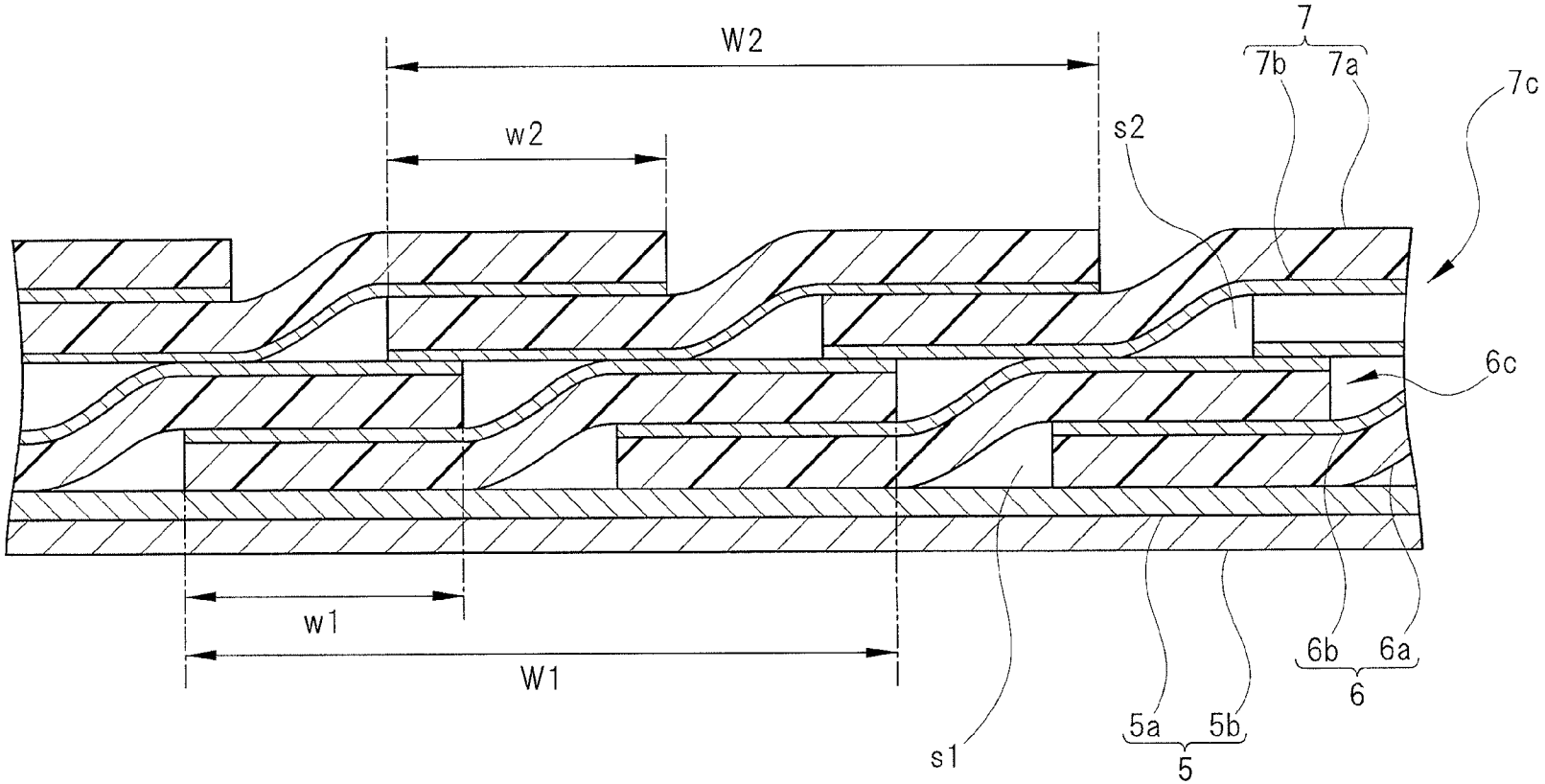
FIG. 2 is a partial enlarged cross-sectional view of the differential signal transmission cable illustrated in FIG. 1.

As illustrated in FIG. 2, the shield tape 5 includes a sheet-shaped resin layer 5*a* and a metal layer 5*b* formed on a surface of the resin layer 5*a*. That is, the shield tape 5 has a double structure. The resin layer 5*a* is formed of an insulating resin material (for example, PET (polyethylene terephthalate)). On the other hand, the metal layer 5*b* is formed of a conductive metal material (for example, copper or aluminum). A thickness of the resin layer 5*a* is, for example, 10 to 15 μm, and a thickness of the metal layer 5*b* is, for example, 6 to 12 μm.

As illustrated in FIG. 1, the shield tape 5 is longitudinally wound around the insulated wire 4 such that the metal layer 5*b* (FIG. 2) is on the inside, and both ends of the shield tape 5 are overlapped with each other. Therefore, the metal layer 5*b* of the shield tape 5 illustrated in FIG. 2 is in contact with an outer surface of the insulated wire 4 (insulator 3) illustrated in FIG. 1. However, when a skin layer is provided around the insulator, the metal layer 5*b* of the shield tape 5 is in contact with the skin layer. Further, in another embodiment, the shield tape 5 is longitudinally or spirally wound around the insulated wire 4 (insulator 3), such that the metal layer 5*b* (FIG. 2) is on the outside. In this case, the resin layer 5*a* of the shield tape 5 is in contact with the insulator 3 or the skin layer.

As illustrated in FIG. 1, the first tape 6 is wound around the insulated wire 4 and the second tape 7 is wound around the first tape 6. Specifically, the first tape 6 is overlapped with and wound on the shield tape 5, and the second tape 7 is overlapped with and wound on the first tape 6. These tapes 6 and 7 have a function to retain the shield tape 5, thereby bringing the shield tape 5 into contact with an outer surface of the insulated wire 4 (insulator 3). Therefore, in the following description, the first tape 6 is called as "a first retention tape 6" and the second tape 7 is called as "a second retention tape 7". As illustrated in FIG. 1, a winding direction of the first retention tape 6 and the second retention tape 7 is the same direction. In other words, the first retention tape 6 and the second retention tape 7 are rotated around a central axis C of the insulated wire 4 in the same direction.

As illustrated in FIG. 2, the first retention tape 6 includes a strip-shaped resin layer 6*a* and a bonding layer 6*b* formed on one surface (surface) of the resin layer 6*a*. That is, the first retention tape 6 has a double structure. The resin layer 6*a* is formed of an insulating resin material (for example, PET (polyethylene terephthalate)). On the other hand, the bonding layer 6*b* is formed of a thermoset bonding agent.

The second retention tape 7 has a double structure as in the first retention tape 6. That is, the second retention tape 7 includes a strip-shaped resin layer 7*a* and a bonding layer 7*b* formed on one surface of the resin layer 7*a*. However, the bonding layer 7*b* of the second retention tape 7 is formed on a back surface of the resin layer 7*a*. That is, in the first retention tape 6 and the second retention tape 7, a position of the bonding layers 6*b* and 7*b* is opposite to the one of the resin layers 6*a* and 7*a*. In the first retention tape 6 and the second retention tape 7, a thickness of the resin layers 6*a* and 7*a* is, for example, 10 to 15 μm, and a thickness of the bonding layers 6*b* and 7*b* is, for example, 2 to 5 μm.

As illustrated in FIG. 1, the first retention tape 6 is spirally wound. Therefore, the first retention tape 6 diagonally traverses an overlapping part 5*c* of the shield tape 5. Further, as illustrated in FIG. 2, the first retention tape 6 is spirally wound such that the both ends in a width direction are overlapped with each other. That is, the first retention tape 6 is overlapped and wound. An overlapping width (w1) between an end of the first retention tape 6 at a lower side and an end of the first retention tape 6 at an upper side is ¼ to ½ of a width (W1) of the first retention tape 6.

Further, in an overlapping part 6*c* of the first retention tape 6, the end of the first retention tape 6 at a lower side and the end of the first retention tape 6 at an upper side are bonded by the bonding layer 6*b* formed in the first retention tape 6 at a lower side. On the other hand, a gap s1 is formed between two adjacent overlapping parts 6*c* along the central axis C (FIG. 1) of the insulated wire 4. That is, the overlapping part 6*c* and the gap s1 are alternatively formed along the central axis C of the insulated wire 4.

As illustrated in FIG. 1, the second retention tape 7 is spirally wound as in the first retention tape 6. Therefore, the second retention tape 7 also diagonally traverses the overlapping part 5*c* (FIG. 1) of the shield tape 5. Further, as illustrated in FIG. 2, the second retention tape 7 is also overlapped and wound. An overlapping width (w2) between an end of the second retention tape 7 at a lower side and an end of the second retention tape 7 at an upper side is ¼ to ½ of a width (W2) of the second retention tape 7.

Further, in an overlapping part 7*c* of the second retention tape 7, the end of the second retention tape 7 at a lower side and the end of the second retention tape 7 at an upper side are bonded by the bonding layer 7*b* formed in the second retention tape 7 at an upper side. On the other hand, a gap s2 is formed between two adjacent overlapping parts 7*c* along the central axis C of the insulated wire 4. That is, the overlapping part 7*c* and the gap s2 are alternatively formed along the central axis C (FIG. 1) of the insulated wire 4.

Further, overlapping parts of the first retention tape 6 and the second retention tape 7 are bonded to each other by the bonding layers 6*b* and 7*b*. That is, the first retention tape 6 and the second retention tape 7 are bonded to each other by the bonding layer 6*b* formed in a surface of the first retention tape 6 and the bonding layer 7*b* formed in a back surface of the second retention tape 7. On the other hand, the first retention tape 6 formed between the second retention tape 7 and the shield tape 5 is not bonded to the shield tape 5. That is, the first retention tape 6 and the second retention tape 7 are not bonded to the shield tape 5.

Further, the gap s1 in the first retention tape 6 and the gap s2 in the second retention tape 7 are alternately formed along the central axis C (FIG. 1) of the insulated wire 4. In other words, the overlapping part 7*c* of the second retention tape 7 is formed outside the gap s1 in the first retention tape 6, and the overlapping part 6*c* of the first retention tape 6 is formed inside the gap s2 in the second retention tape 7.

Although not illustrated, a jacket (referred to as "sheath" in some cases) formed of resins having a good flame resistance such as polyvinyl chloride is provided outside the second retention tape 7.

Figure 3:
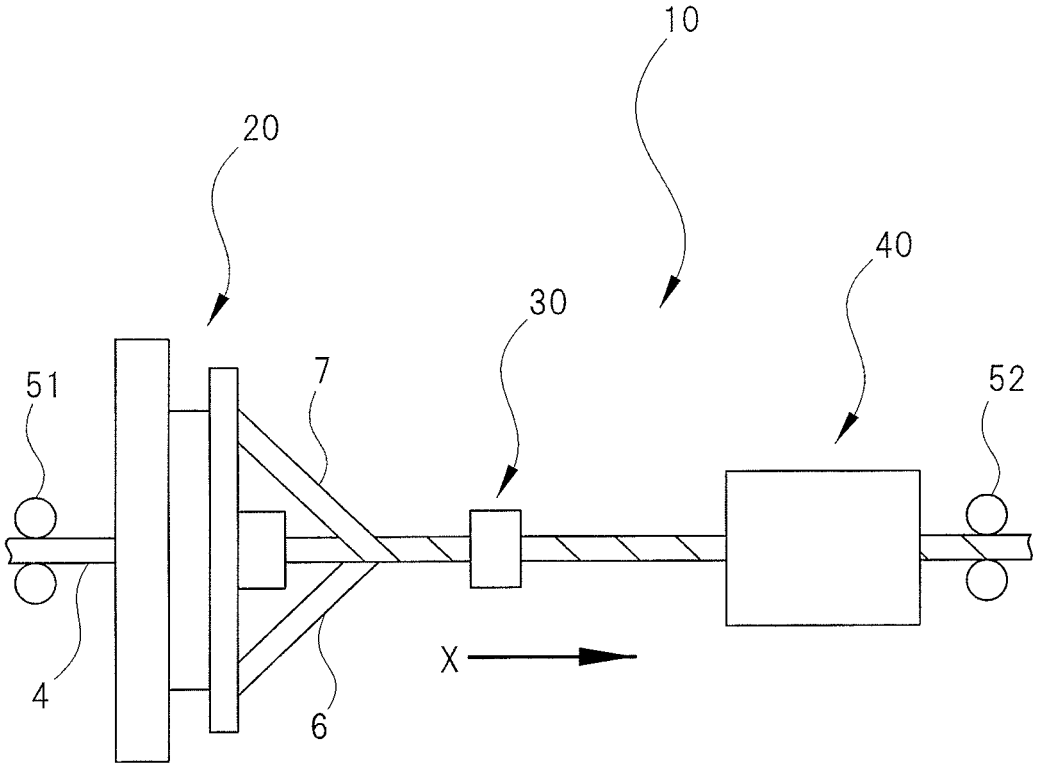
FIG. 3 is a block diagram of a manufacturing device according to an embodiment of the present invention.

Next, an example of a manufacturing device and a manufacturing method of the differential signal transmission cable 1 illustrated in FIGS. 1 and 2 will be described. As illustrated in FIG. 3, an manufacturing device 10 includes a winding head 20 that winds the first retention tape 6 and the second retention tape 7 around the insulated wire 4, a twist preventing jig 30 that prevents twisting of the insulated wire 4 having the first retention tape 6 and the second retention tape 7 wound therearound, and a heating furnace 40 that thermally cures the bonding layers 6*b* and 7*b* (FIG. 2) provided in the first retention tape 6 and the second retention tape V.

Figure 4:
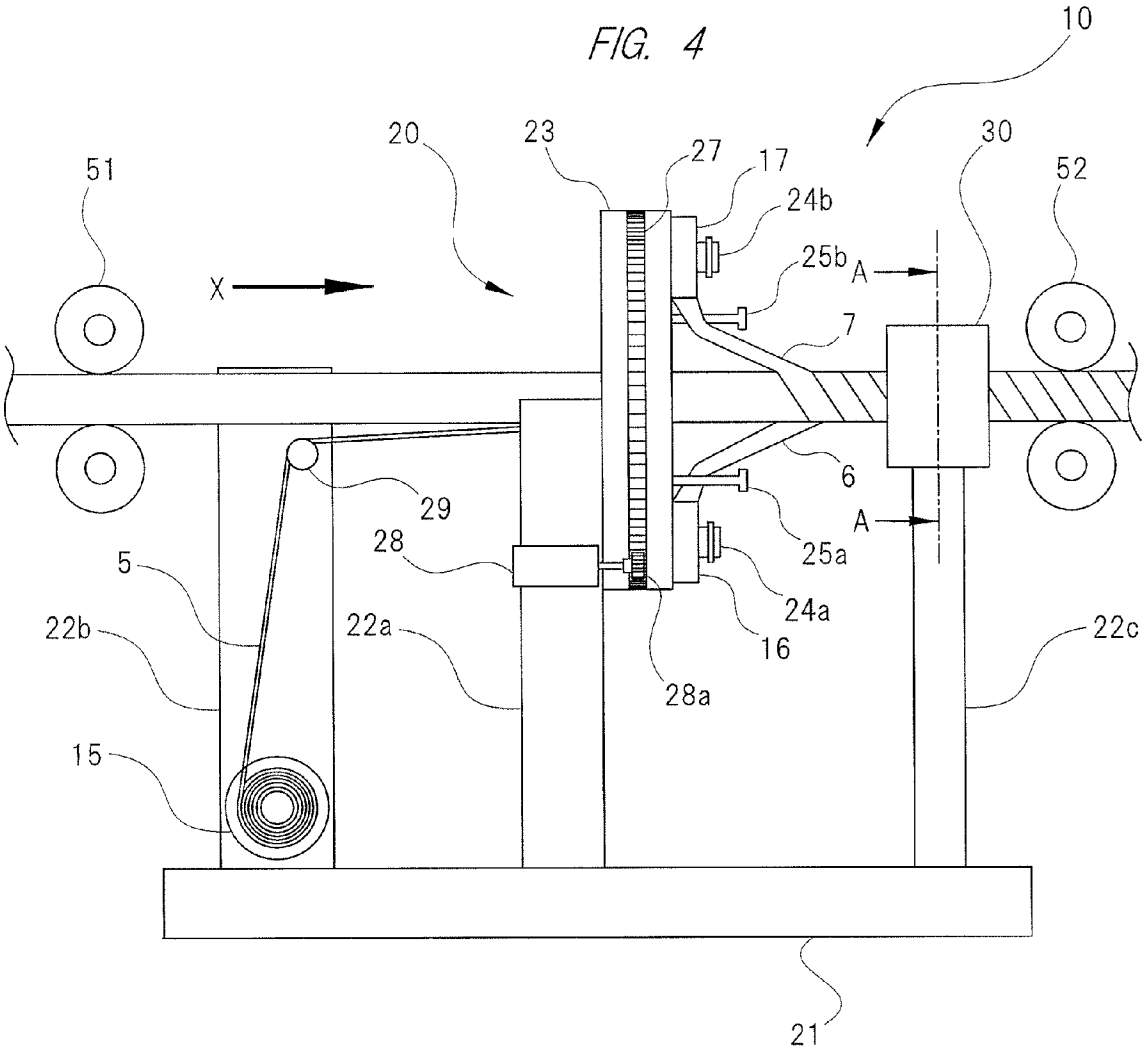
FIG. 4 is a side view of the manufacturing device illustrated in FIG. 1.

As illustrated in FIG. 4, the winding head 20 is supported by a column 22*a* extending from a base 21. The winding head 20 includes an annular member 23 rotatably attached to the column 22*a* through a bearing (not illustrated), a first supporting axis 24*a* and a second supporting axis 24*b* both extending from one surface of the annular member 23, and a first guide pin 25*a* and a second guide pin 25*b* both extending from one surface of the annular member 23 in parallel with the first supporting axis 24*a* and the second supporting axis 24*b*.

Figure 5:
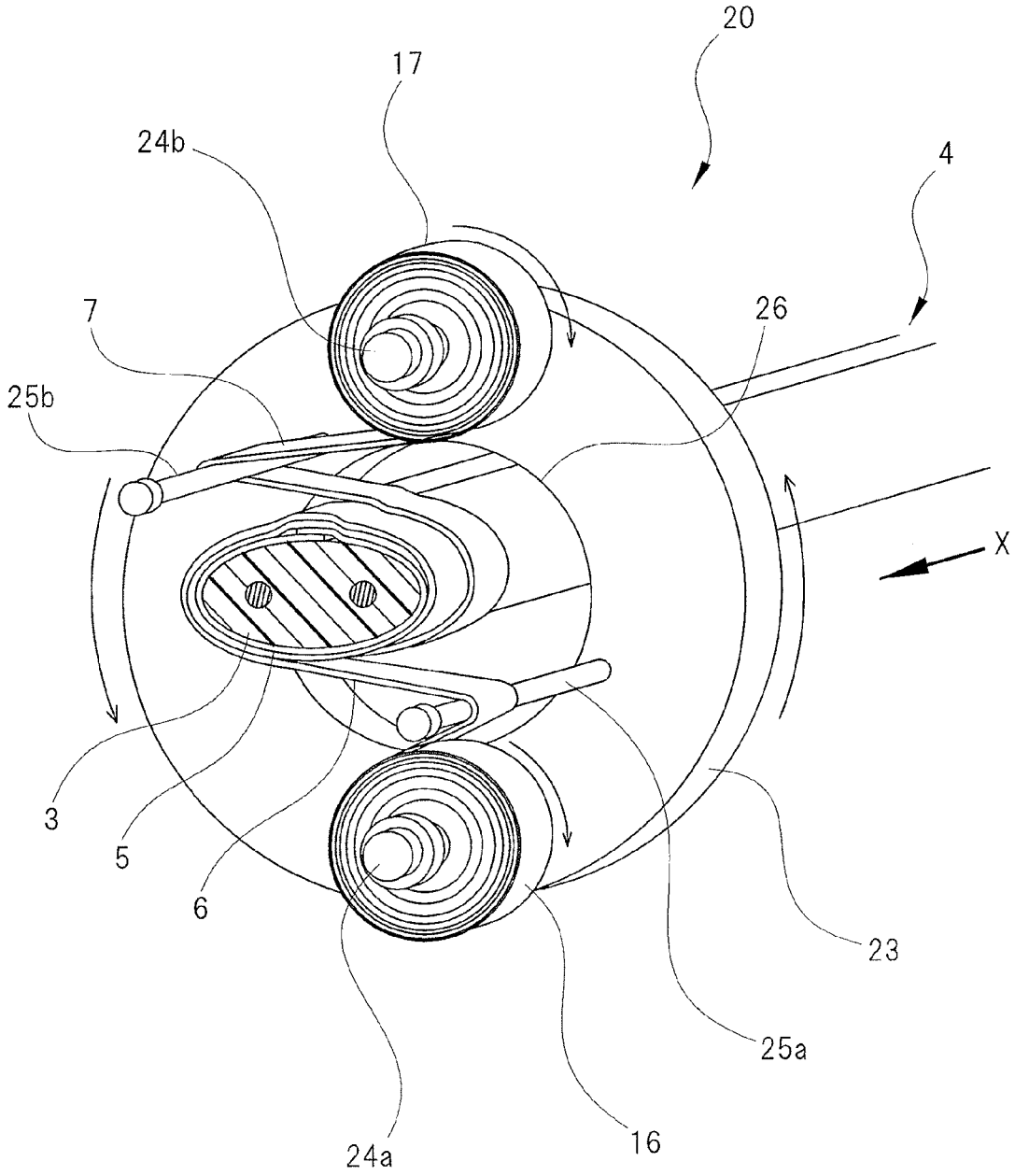
FIG. 5 is an enlarged perspective view of a winding head illustrated in FIG. 4.

As illustrated in FIG. 5, a circular opening 26 through which the insulated wire 4 is passed is formed in a center of the annular member 23. Further, as illustrated in FIG. 4, a gear tooth 27 is formed on an outer surface of the annular member 23. On the other hand, a motor 28 is fixed to the column 22*a*, a pinion gear 28*a* meshed with the gear tooth 27 is fixed to a rotational axis of the motor 28. That is, the annular member 23 is rotary driven by the motor 28.

As illustrated in FIG. 5, the first supporting axis 24*a* and the second supporting axis 24*b* are disposed in a position with 180 degree difference across a center of the opening 26. Similarly, the first guide pin 25*a* and the second guide pin 25*b* are disposed in a position with 180 degree difference across a center of the opening 26. The supporting axes 24*a* and 24*b* and the guide pins 25*a* and 25*b* rotate around the insulated wire 4 passing through the opening 26 in the same direction, in accordance with rotation of the annular member 23. In other words, the supporting axes 24*a* and 24*b* and the guide pins 25*a* and 25*b* rotate in the same direction, taking the central axis C (FIG. 1) of the insulated wire 4 passing through the opening 26 as a rotational axis.

The first supporting axis 24*a* is inserted into a reel 16 having the first retention tape 6 wound therearound, and the reel 16 is rotatably supported by the first supporting axis 24*a*. The second supporting axis 24*b* is inserted into a reel 17 having the second retention tape 7 wound therearound, and the reel 17 is rotatably supported by the second supporting axis 24*b*. Note that the first supporting axis 24*a* and the second supporting axis 24*b* provide rotational resistance to reels 16 and 17.

As illustrated in FIG. 4, a reel 15 having the shield tape 5 wound therearound is rotatably supported at a lower part of the other column 22*b* extending from the base 21. Further, a guide roller 29 that guides the shield tape 5 extracted from the reel 15 is provided at an upper part of the column 22*b*. Moreover, the twist preventing jig 30 is provided at an upper part of the other column 22*c* extending from the base 21.

Figure 6:
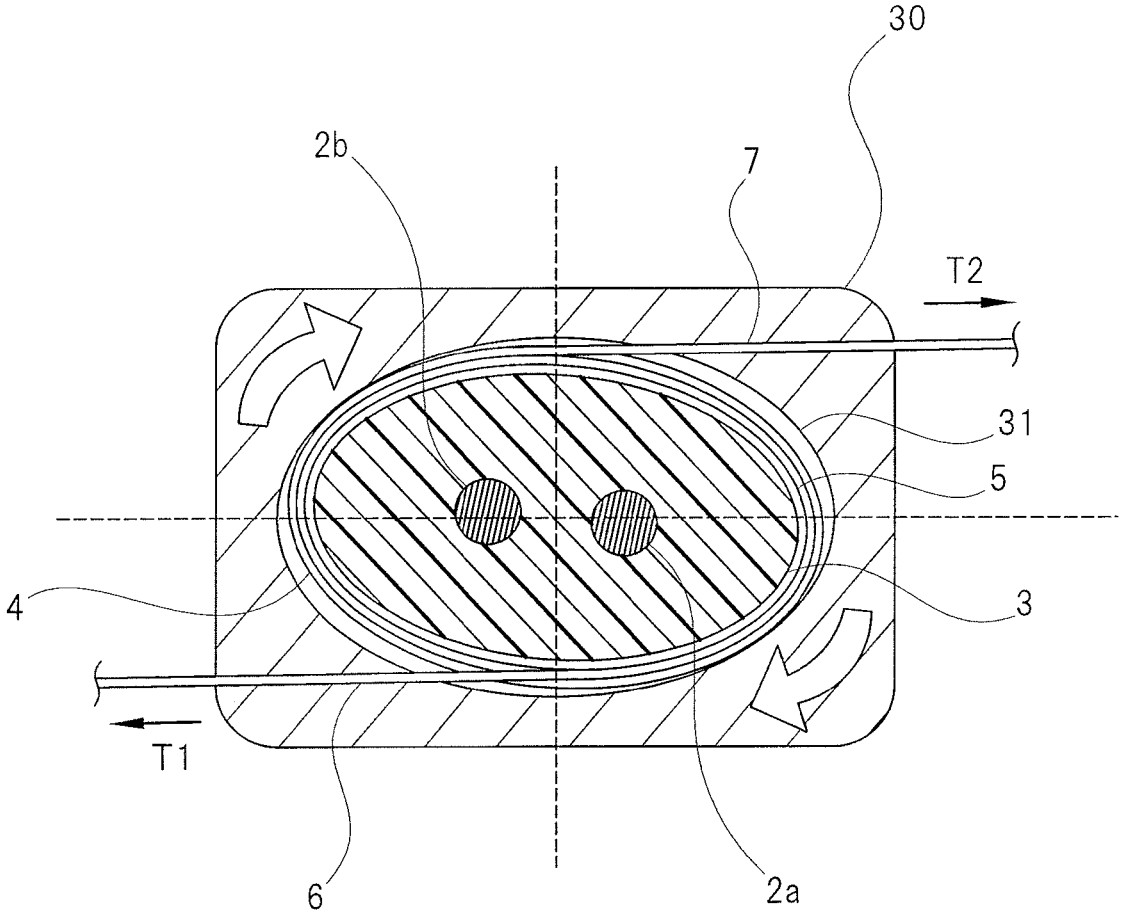
FIG. 6 is an enlarged cross-sectional view of a twist preventing jig taken along the line A-A illustrated in FIG. 4.

As illustrated in FIG. 6, the twist preventing jig 30 includes a restriction portion 31 through which the insulated wire 4 is passed, the insulated wire 4 having the first retention tape 6 and the second retention tape 7 wound therearound. The restriction portion 31 is a through-hole having the substantially same cross-sectional shape and size as those of the insulated wire 4 having the first retention tape 6 and the second retention tape 7 wound therearound. Specifically, the restriction portion 31 is a nearly ellipsoidal-shaped through-hole having an inner diameter slightly larger than an outer diameter of the insulated wire 4 having the first retention tape 6 and the second retention tape 7 wound therearound. The restriction portion 31 allows the insulated wire 4, having the first retention tape 6 and the second retention tape 7 wound therearound, to move along a longitudinal direction, while restricting (not allowing) the insulated wire 4 to rotate. Herein, a rotation of the insulated wire 4 means a rotation of the insulated wire 4 in a circumferential direction, that is, a twist of the insulated wire 4.

As illustrated in FIGS. 3 and 4, in order to move the insulated wire 4 in a longitudinal direction, a plurality of roller pairs are optionally disposed on a movement path of the insulated wire 4. In the present embodiment, a pair of rollers 51 and a pair of rollers 52 are respectively disposed at the front and the back of the winding head 20. Specifically, as illustrated in FIG. 4, a pair of driven rollers 51 is disposed in front of the column 22*b* and a pair of conveyance rollers 52 is disposed ahead of the column 22*c*. The conveyance rollers 52 are rotary driven by a drive mechanism (not illustrated) and the driven rollers 51 are rotated following movement of the insulated wire 4. In the present embodiment, the insulated wire 4 is conveyed from the left side in FIGS. 3 and 4 to the right side in the same figures. That is, an arrow X direction illustrated in FIGS. 3 and 4 is a movement direction of the insulated wire 4.

As illustrated in FIG. 4, the column 22*a* that supports the winding head 20 and the column 22*c* that supports the twist preventing jig 30 are arranged in this order along a movement direction (arrow X direction) of the insulated wire 4. That is, the twist preventing jig 30 is disposed ahead of the winding head 20 in the movement direction of the insulated wire 4. Further, as illustrated in FIG. 3, the heating furnace 40 is disposed ahead of the twist preventing jig 30 in the movement direction of the insulated wire 4. In other words, the twist preventing jig 30 is disposed on the movement path of the insulated wire 4, and disposed between the winding head 20 and the heating furnace 40.

Next, a method for manufacturing the differential signal transmission cable 1 illustrated in FIG. 1 will be described, the method using the manufacturing device 10 illustrated in FIG. 3.

First, the insulated wire 4 illustrated in FIG. 1 is prepared, and the prepared insulated wire 4 is set to the manufacturing device 10 illustrated in FIG. 3. Specifically, a tip of the insulated wire 4 is held between a pair of the driven rollers 51. Next, the insulated wire 4 held between the pair of the driven rollers 51 is pulled to pass the insulated wire 4 through the winding head 20, the twist preventing jig 30 and the heating furnace 40. Further, a tip of the insulated wire 4 is extracted from the heating furnace 40 to hold the tip between a pair of the driven rollers 52.

After completion of the preparation steps described above, the insulated wire 4 is moved to an arrow X direction by rotating the pair of the driven rollers 52 illustrated in FIGS. 3 and 4. Simultaneously, the annular member 23 of the winding head 20 illustrated in FIG. 4 is rotated, heating is started by the heating furnace 40 illustrated in FIG. 3. Note that rotational resistance is provided to the pair of the driven rollers 51. Therefore, the insulated wire 4 is pulled to the arrow X direction by the pair of the driven rollers 52, while being braked by the pair of the driven rollers 51. That is, back tension is applied to the insulated wire 4.

When the insulated wire 4 moves in accordance with rotation of the pair of the driven rollers 52, the shield tape 5 is extracted from the reel 15 illustrated in FIG. 4 and guided to around the insulated wire 4 by the guide roller 29. The shield tape 5 guided to around the insulated wire 4 is wound around the insulated wire 4 by a guide mechanism (not illustrated). Specifically, the shield tape 5 is longitudinally wound around the insulator 3 (FIG. 1) of the insulated wire 4.

Further, when the annular member 23 of the winding head 20 is rotated, the first retention tape 6 is extracted from the reel 16 as illustrated in FIGS. 4 and 5, guided to around the insulated wire 4 by the first guide pin 25*a*, and wound around the insulated wire 4. Specifically, the first retention tape 6 is spirally wound on the previously wound shield tape 5. Simultaneously, the second retention tape 7 is extracted from the reel 17, guided to around the insulated wire 4 by the second guide pin 25*b*, and wound around the first retention tape 6. Specifically, the second retention tape 7 is spirally wound on the previously wound first retention tape 6. That is, the manufacturing method according to the present embodiment includes a first step of winding the first retention tape 6 around the insulated wire 4 while moving the insulated wire 4 in a longitudinal direction, and a second step of winding the second retention tape 7 around the first retention tape 6 while moving the insulated wire 4 to a longitudinal direction.

Figure 7:
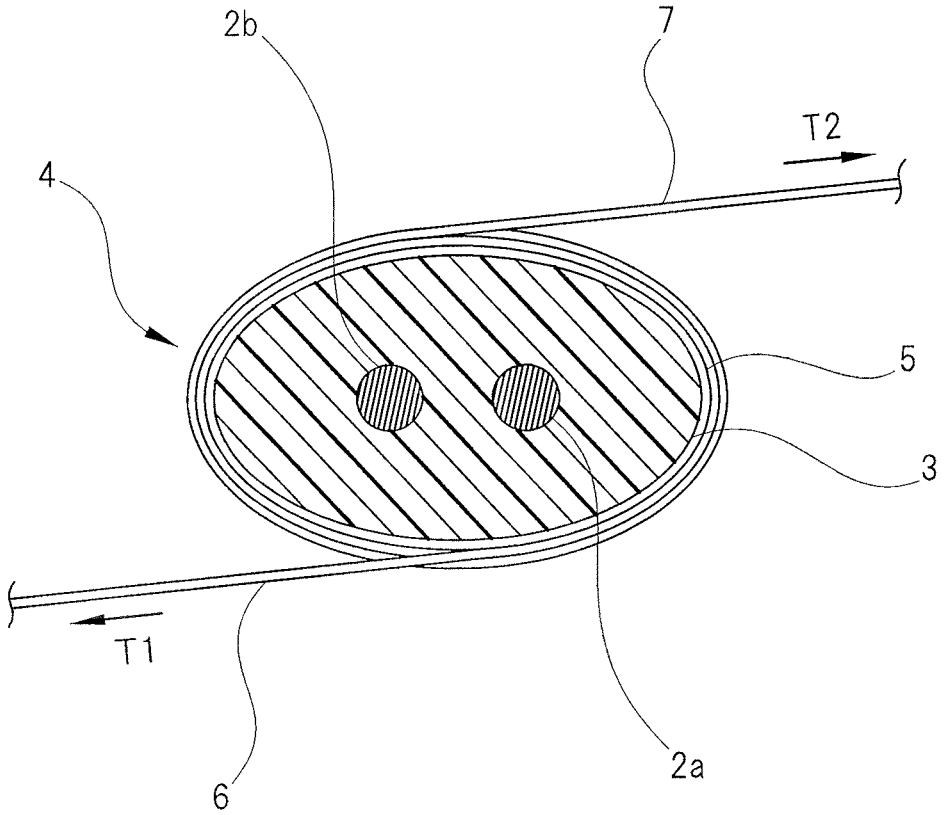
FIG. 7 is an explanatory view illustrating tensile force acting on an insulated wire in accordance with winding of a tape.

Herein, illustrated in FIG. 7, tensile force (T1) is applied to the insulated wire 4 in accordance with winding of the first retention tape 6, and tensile force (T2) is applied to the insulated wire 4 in accordance with winding of the second retention tape 7. However, in the present embodiment, the reel 16 and the reel 17 illustrated in FIG. 5 are simultaneously rotated in the same direction. Therefore, the first retention tape 6 and the second retention tape 7 are simultaneously wound around the insulated wire 4 in the same direction. Further, the first supporting axis 24*a* that supports the reel 16 and the second supporting axis 24*b* that supports the reel 17 are disposed with 180 degree difference across a center of the opening 26 of the annular member 23. That is, the reel 16 and the reel 17 are opposed to each other across the central axis C (FIG. 1) of the insulated wire 4. Therefore, as illustrated in FIG. 7, as to the tensile force (T1) applied to the insulated wire 4 in accordance with winding of the first retention tape 6 and tensile force (T2) applied to the insulated wire 4 in accordance with winding of the second retention tape 7, such forces are compensated with each other, thereby preventing the insulated wire 4 from being rotated, that is, from being twisted.

Further, as illustrated in FIGS. 3 and 4, the insulated wire 4 having the first retention tape 6 and the second retention tape 7 wound therearound is sent to the heating furnace 40 through the restriction portion 31 (FIG. 6) of the twist preventing jig 30, which is disposed ahead of a position where the first retention tape 6 and the second retention tape 7 are wound. That is, when the first retention tape 6 and the second retention tape 7 are wound around a part of the insulated wire 4, the other part of the insulated wire 4 having the first retention tape 6 and the second retention tape 7 already wound therearound is in the process of passing through the restriction portion 31 of the twist preventing jig 30. As described above, the restriction portion 31 allows the insulated wire 4 to move along a longitudinal direction, but does not allow the insulated wire 4 to rotate. Thus, in a state that the insulated wire 4 is prevented from being twisted, the first step and the second step described above are carried out ahead of a winding position of the first retention tape 6 and the second retention tape 7. Therefore, in accordance with winding of the first retention tape 6 and the second retention tape 7, the insulated wire 4 is further prevented from being twisted.

The insulated wire 4 having the first retention tape 6 and the second retention tape 7 wound therearound as described above is sent to the heating furnace 40 illustrated in FIG. 3. The insulated wire 4 sent to the heating furnace 40 is heated to a predetermined temperature by a heater (not illustrated) provided in the heating furnace 40 while passing through the heating furnace 40. The bonding layers 6*b* and 7*b* (FIG. 2) provided in the first retention tape 6 and the second retention tape 7 are thermally cured by this heating. That is, the manufacturing method according to the present embodiment includes a third step for thermally curing the bonding layers 6*b* and 7*b* (FIG. 2) provided in the first retention tape 6 and the second retention tape 7. According to the third step, the overlapping part 6*c* of the first retention tape 6 is bonded, the overlapping part 7*c* of the second retention tape 7 is bonded, and the overlapping part of the first retention tape 6 and the second retention tape 7 is bonded.

As described above, in the manufacturing method according to the present embodiment, a step of winding the shield tape 5, a step of winding the first retention tape 6 (first step), a step of winding the second retention tape 7 (second step), and a step of thermally curing the bonding layers 6*b* and 7*b* provided in the first retention tape 6 and the second retention tape 7 (third step) are concurrently carried out. Then, in the first step and the second step, the first retention tape 6 and the second retention tape 7 are simultaneously wound around the insulated wire 4 in the same direction. Further, the first step and the second step are carried out in a state that the insulated wire 4 is prevented from being twisted by the twist preventing jig 30. Therefore, in accordance with winding of the first retention tape 6 and the second retention tape 7, the insulated wire 4 is efficiently prevented from being twisted. As a result, a gap between the insulated wire 4 and the shield tape 5 is prevented from being generated.

Figure 8:
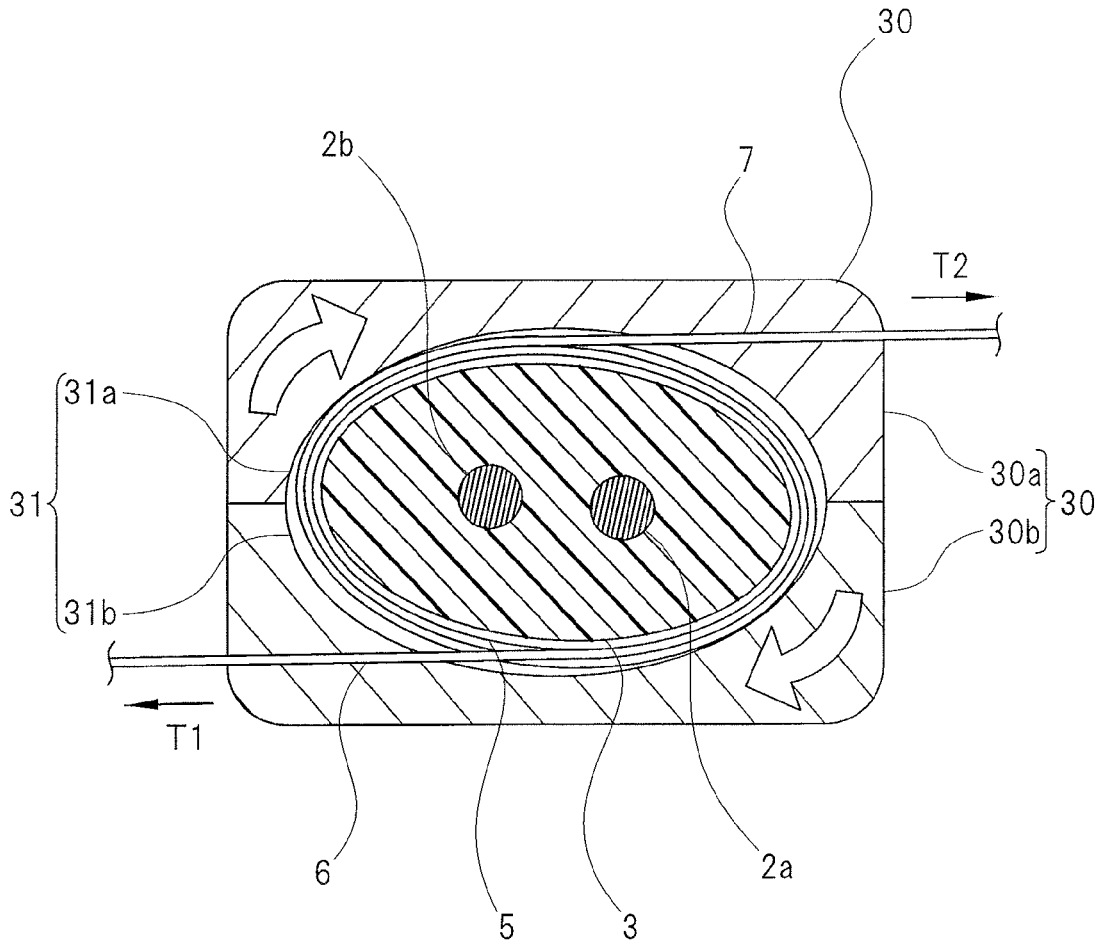
FIG. 8 is an enlarged view illustrating a modification example of the twist preventing jig.

In the foregoing, the invention made by the present inventor has been concretely described based on the embodiment. However, it is needless to say that the present invention is not limited to the foregoing embodiment and various modifications and alterations can be made within the scope of the present invention. For example, an essential function of the twist preventing jig 30 illustrated in FIGS. 3 and 4 is to prevent the insulated wire 4 from being twisted, in accordance with winding of the first retention tape 6 and the second retention tape 7. Therefore, a position of the twist preventing jig 30 can be optionally changed as long as the above-mentioned essential function is obtained. Further, a shape and size of the restriction portion 31 provided in the twist preventing jig 30 can also be optionally changed as long as the above-mentioned essential function is obtained. One modification of the twist preventing jig 30 is illustrated in FIG. 8. The twist preventing jig 30 illustrated in FIG. 8 includes two members (upper part member 30*a* and lower part member 30*b*). A semicircular arc-shaped groove 31*a* and semicircular arc-shaped groove 31*b* are respectively formed in the upper part member 30*a* and the lower part member 30*b*. When the upper part member 30*a* and the lower part member 30*b* are abutted with each other, a through-hole is formed by two grooves 31*a* and 31*b* as the restriction portion 31.

Figure 9:
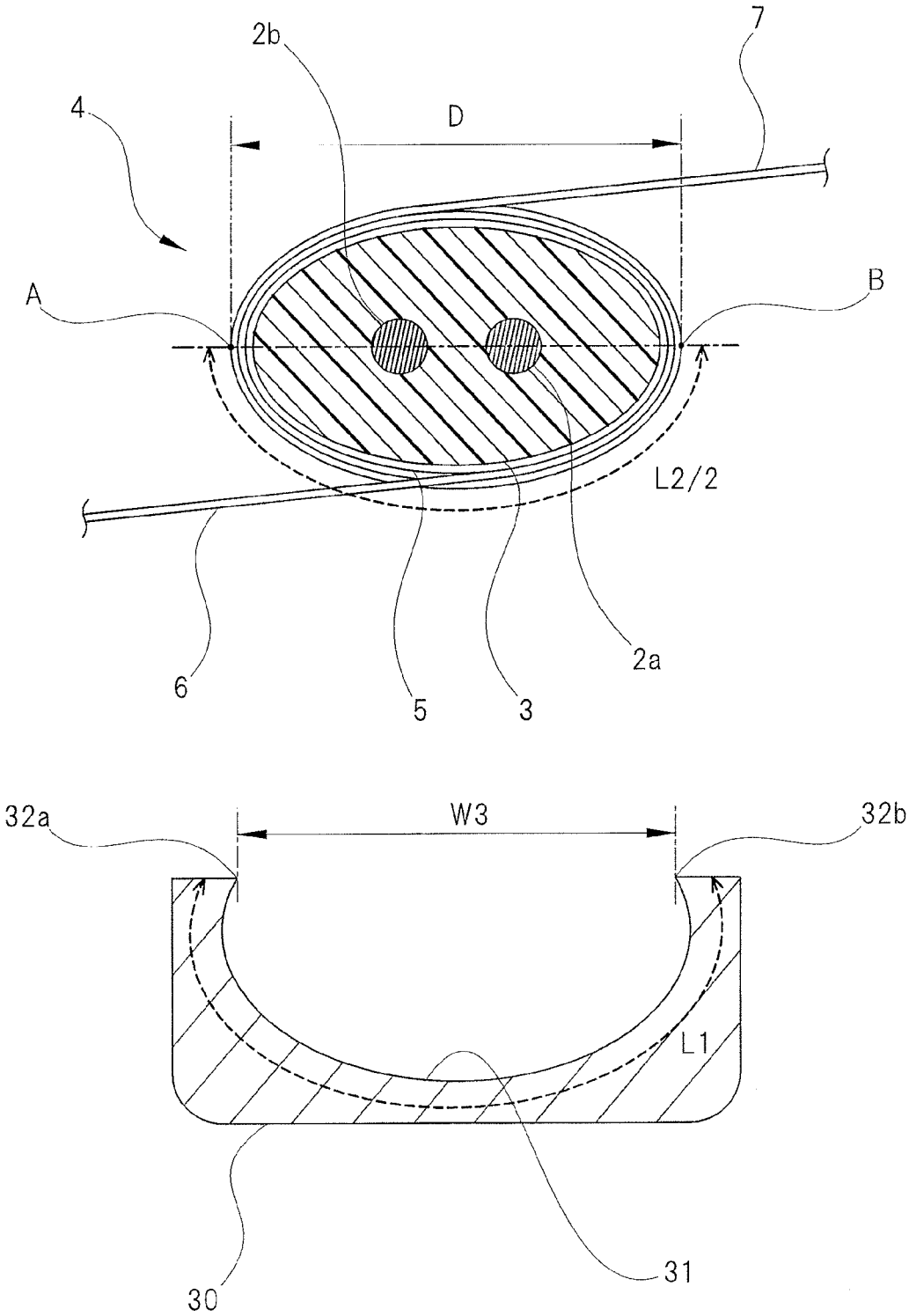
FIG. 9 is an enlarged view illustrating another modification example of the twist preventing jig.

Another modification of the twist preventing jig 30 illustrated in FIGS. 3 and 4 will be illustrated in FIG. 9. A circular arc-shaped groove is formed in the twist preventing jig illustrated in FIG. 9, as the restriction portion 31. A cross-sectional perimeter (L1) of the restriction portion 31 (circular arc-shaped groove) is longer than a half (½) length of a cross-sectional perimeter (L2) of the insulated wire 4 having the first retention tape 6 and the second retention tape 7 wound therearound. Herein, the cross-sectional perimeter (L2) of the insulated wire 4 is equal to a length of an outer periphery of the insulated wire 4 in a cross section (traverse section) vertical to the central axis C (FIG. 1) of the insulated wire 4. On the other hand, the cross-sectional perimeter (L1) of the restriction portion 31 is equal to a length of an inner periphery of the restriction portion 31 in a cross section horizontal to the traverse section.

In other words, a relationship between the cross-sectional perimeter (L1) of the restriction portion 31 and the cross-sectional perimeter (L2) of the insulated wire 4 is as follows. That is, an opening width (W3) of the restriction portion 31 is slightly narrower than a long diameter (D) of the insulated wire 4 having the first retention tape 6 and the second retention tape 7 wound therearound. Herein, an opening width (W3) of the restriction portion 31 is equal to a length of a line segment connecting one edge 32*a* and the other edge 32*b* of the restriction portion 31. On the other hand, the long diameter (D) of the insulated wire 4 is equal to a length of a line segment connecting two intersections (intersection A and intersection B) of a straight line going through a center of two signal line conductors 2*a* and 2*b* and an outer surface of the insulated wire 4.

Figure 10:
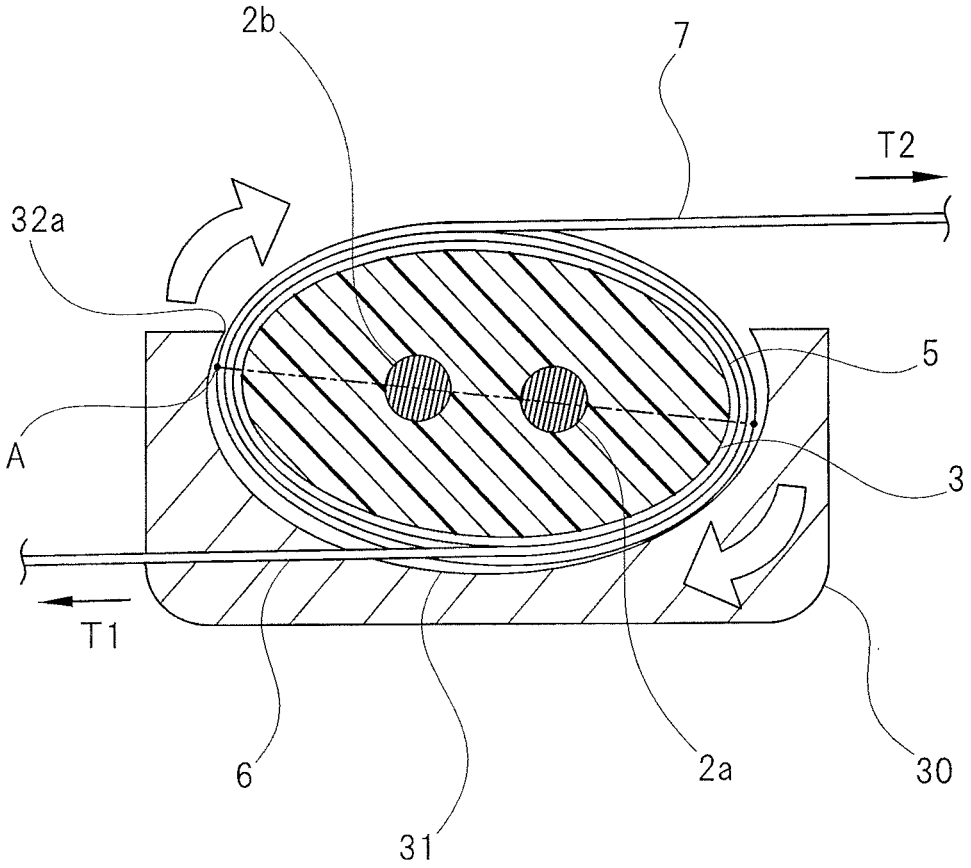
FIG. 10 is an enlarged view illustrating application of the twist preventing jig illustrated in FIG. 9.

As illustrated in FIG. 10, when the above-described relationship is satisfied in the cross-sectional perimeter (L1) of the restriction portion 31 and the cross-sectional perimeter (L2) of the insulated wire 4, the most part is covered by an inner surface of the restriction portion 31 more than a half (½) of the outer surface of the insulated wire 4. As a result, although a rotation force generated by tensile force (T1 and T2) is applied to the insulted wire 4 in the restriction portion 31, the insulated wire 4 is prevented from being rotated, that is, from being twisted. In other words, the intersection A never goes outside the restriction portion 31 by crossing over the edge 32*a* of the restriction portion 31.

Note that the above-described relationship is satisfied in the cross-sectional perimeter (L1) of the restriction portion 31 and the cross-sectional perimeter (L2) of the insulated wire 4, even in the embodiment illustrated in FIGS. 6 and 8.

In the foregoing embodiments, both of the first retention tape 6 and the second retention tape 7 are a retention tape. However, the first retention tape 6 can be changed to a shield tape to be wound around the insulated wire 4 (insulator 3). In this case, the first retention tape 6 as a shield tape is retained by the second retention tape.

In the foregoing embodiments, a bonding layer is provided in both of the first retention tape 6 and the second retention tape 7. However, in another embodiment, a bonding layer is only provided in either of the first retention tape 6 and the second retention tape 7. Further, a material of the bonding layer is not limited to a thermoset bonding agent. For example, in another embodiment, the bonding layer is formed of a UV-curable bonding agent. In this case, UV irradiation means is provided, instead of the heating furnace 40 illustrated in FIG. 3.

What is claimed is:

1. A manufacturing device of a differential signal transmission cable including an insulated wire in which a pair of signal line conductors is coated by an insulator, a first tape spirally wound around the insulated wire, and a second tape spirally wound around the first tape, the manufacturing device comprising:

a winding head that winds the first tape and the second tape around the insulated wire in a same direction, the insulated wire which moves along a longitudinal direction; and a twist preventing jig that is disposed ahead of the winding head in a movement direction of the insulated wire, and prevents the insulated wire from being twisted.

2. The manufacturing device of the differential signal transmission cable according to claim 1, further comprising:

a heating furnace that is disposed ahead of the winding head in a movement direction of the insulated wire, and thermally cures a bonding layer provided in at least either of the first tape and the second tape, wherein the twist preventing jig is disposed on a movement path of the insulated wire and between the winding head and the heating furnace.

3. The manufacturing device of the differential signal transmission cable according to claim 1, wherein the twist preventing jig includes a restriction portion through which the insulated wire is passed, the insulated wire having the first tape and the second tape wound therearound, and the restriction portion is a through-hole or a circular arc-shaped groove, which allows the insulated wire having the first tape and the second tape wound therearound to move along a longitudinal direction of the insulated wire, but restricts the insulated wire to rotate in a circumferential direction.

4. The manufacturing device of the differential signal transmission cable according to claim 2, wherein the twist preventing jig includes a restriction portion through which the insulated wire is passed, the insulated wire having the first tape and the second tape wound therearound, and the restriction portion is a through-hole or a circular arc-shaped groove, which allows the insulated wire having the first tape and the second tape wound therearound to move along a longitudinal direction of the insulated wire, but restricts the insulated wire to rotate in a circumferential direction.

5. A manufacturing method of a differential signal transmission cable comprising:

a first step of spirally winding a first tape around an insulated wire while moving the insulated wire in which a pair of signal line conductors is coated by an insulator in a longitudinal direction; and a second step of spirally winding a second tape around the first tape in a same direction as a winding direction of the first tape, while moving the insulated wire in a longitudinal direction, wherein the first step and the second step are carried out in a state that the insulated wire is prevented from being twisted ahead of a winding position of the first tape and second tape for the insulated wire in a movement direction of the insulated wire.

6. The manufacturing method of the differential signal transmission cable according to claim 5, wherein the insulated wire is prevented from being twisted by passing a twist preventing jig through the insulated wire, the twist preventing jig being disposed ahead of the winding direction in a movement direction of the insulated wire.

7. The manufacturing method of the differential signal transmission cable according to claim 6, further comprising:

a third step of thermally curing a bonding layer provided in at least either of the first tape and the second tape, wherein the twist preventing jig is disposed between a winding head that carries out the first step and the second step and a heating furnace that carries out the third step.

8. The manufacturing method of the differential signal transmission cable according to claim 6, wherein the twist preventing jig includes a restriction portion through which the insulated wire is passed, the insulated wire having the first tape and the second tape wound therearound, and the restriction portion is a through-hole or a circular arc-shaped groove, which allows the insulated wire having the first tape and the second tape wound therearound to move along a longitudinal direction of the insulated wire, but restricts the insulated wire to rotate in a circumferential direction.

9. The manufacturing method of the differential signal transmission cable according to claim 7, wherein the twist preventing jig includes a restriction portion through which the insulated wire is passed, the insulated wire having the first tape and the second tape wound therearound, and the restriction portion is a through-hole or a circular arc-shaped groove, which allows the insulated wire having the first tape and the second tape wound therearound to move along a longitudinal direction of the insulated wire, but restricts the insulated wire to rotate in a circumferential direction.

10. The manufacturing method of the differential signal transmission cable according to claim 5, wherein the first tape and the second tape are a retention tape that is overlapped with and wound on a shield tape, which is preliminarily wound around the insulated wire.

11. The manufacturing method of the differential signal transmission cable according to claim 5, wherein the first tape is a shield tape to be wound around the insulated wire, and the second tape is a retention tape that is overlapped with and wound on the shield tape.

* * * * *